United States Patent [19]

Breitbard

[11] 4,109,890

[45] Aug. 29, 1978

[54] TELEPHONE SUPPORTED DIRECTORY INFORMATION SUPPORT RACK

[75] Inventor: Elford Barnett Breitbard, San Diego, Calif.

[73] Assignee: Tele-Quik, Inc., San Diego, Calif.

[21] Appl. No.: 783,020

[22] Filed: Mar. 30, 1977

Related U.S. Application Data

[63] Continuation of Ser. No. 677,373, Apr. 15, 1977, abandoned.

[51] Int. Cl.[2] ..... A47B 19/00

[52] U.S. Cl. ..... 248/452; 248/441 C; 248/459; 281/15 B

[58] Field of Search ..... 248/441 B, 441 C, 442.2, 248/452, 459, 226.5; 179/146 R, 178; 40/336; 281/15 B; 402/60; 24/67.11

[56] References Cited

U.S. PATENT DOCUMENTS

| | | | |
|---|---|---|---|
| 262,248 | 8/1882 | Salisbury | 248/452 |
| 1,226,452 | 5/1917 | Bolton | 248/441 C X |
| 1,228,083 | 5/1917 | Warfel | 248/441 C X |
| 1,563,508 | 12/1925 | Maynard | 248/452 C |
| 2,130,920 | 9/1938 | Faye | 281/15 B |
| 2,157,020 | 5/1939 | Sanford | 248/226 E X |
| 2,500,837 | 3/1950 | Le Vine | 248/226.5 |
| 2,879,342 | 3/1959 | Bagley | 179/146 R |
| 3,166,288 | 1/1965 | Eisenberg | 248/441 C |
| 3,176,951 | 4/1965 | McFadyen et al. | 248/360 X |
| 3,266,819 | 8/1966 | Huff | 40/336 Y |

*Primary Examiner*—William H. Schultz
*Attorney, Agent, or Firm*—Brown & Martin

[57] ABSTRACT

A telephone directory rack having an upwardly inclined flat portion that is supported on one side by a downwardly projecting side member, which side member is joined at its edge to the edge of the upright planar member, and the lower edge of the side member having a securing device that fits underneath the side of the telephone shell holding the directory in a stable and yet resting position on the support that supports the telephone, so that leaf-type directory information can be placed on the flat surface in close proximity to the telephone and be easily seen and used.

4 Claims, 5 Drawing Figures

TELEPHONE SUPPORTED DIRECTORY INFORMATION SUPPORT RACK

This is a continuation of application, Ser. No. 677,373, filed Apr. 15, 1976, now abandoned.

BACKGROUND OF THE INVENTION

There are existing devices that are mounted onto telephone structures for providing quick directory information. These devices are often used to provide directory information in hotels, motels and the like. Such known units comprise a slide mechanism that fits under the telephone and is pulled forward from underneath the telephone for use.

With the advent of new dialing information, it is desirable that a telephone directory information support rack be so positioned that it is always within the telephone user's sight. Then the telephone user will be more aware that such directory information exists, and will be more apt to use the information.

The foregoing particularly applies to direct dialing information. This information particularly benefits the telephone company, as it reduces the amount of personnel time required to handle direct dialed and credit card dialed telephone calls.

The problems with the existing under the telephone mounted devices are that these devices are not effectively within the user's view. To use such devices, the user must first recognize or notice the existence of the under the telephone positioned directory, and then must slide out the directory to view the information. This unfortunately seldom occurs. Also, the space underneath the telephone for mounting such a slidable device, of necessity causes the device when being moved to directly contact the particular surface, such as a wood cabinet or the like, on which the telephone is positioned. This mars the surface. Further, the space only allows a limited amount of information to be placed into the directory.

So, it is advantageous to have a new and improved telephone supported directory information support rack that is positioned to the side of the telephone, is rigidly but removably secured thereto, that does not move in and out from the telephone thus marring the surface underneath the telephone, and that provides a ready, quick and easily seen place for positioning important dialing instructions and other such information for telephone users.

SUMMARY OF THE INVENTION

In a preferred embodiment of this invention, a first flat or planar member is connected at one of its sides to a second planar member. The second planar member projects downwardly at a normal angle terminating in a bottom side edge that has an acute angle with the line of the intersection of the side edges of the first and second planar members. The lower edge of the second planar member has securing means, generally comprising hook members that hook under the side of the telephone housing, supporting the first planar member in an upright, upwardly inclined direction forming a surface for supporting telephone directory information. The securing means or members hold the structure in a secured and solid position. Thus the flat surface of the first planar member angles so that it presents a full view to all users of the telephone. A retainer means is positioned on the first planar member to secure in position the directory information. Thus the directory information is clearly presented to the telephone user's eye each time the telephone user uses the phone. So the dialing information and other information useful to the user of the phone, that also reduces the services of the telephone company, are always in the user's view. Yet the support rack structure is quickly installed or removed from the existing telephone without having to manipulate or remove portions of the telephone structure.

Further the directory information, so positioned on the first planar member, can be quickly flipped to use second and succeeding pages that may be indexed as desired. The solid rack structure is relatively light weight, and yet is made of plastic or other suitable materials that provide a rigid structure. An adapter U-shaped member is also usable with the rack structure to allow the support rack to be supported on other style telephone housings.

It is therefore an object of this invention to provide a new and improved telephone supported directory information support rack.

It is also an object of this invention to provide a new and improved telephone supported directory information support rack that is easy to construct, is easy to install, provides a full display of information to all users of the telephone at all times, and that does not mar the surface on which the telephone is positioned.

Other objects and many advantages of this invention will become more apparent upon a reading of the following detailed description and an examination of the drawing, wherein like reference numerals designate like parts throughout and in which.

Figure 1:
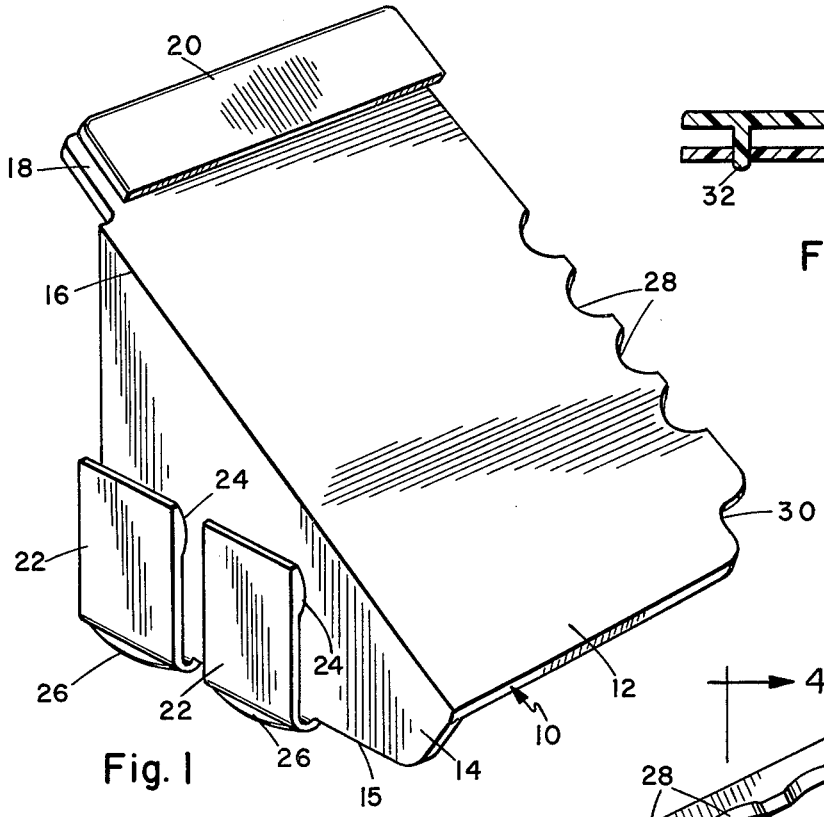
FIG. 1 is a perspective view of a preferred embodiment of the invention.
Figure 3:
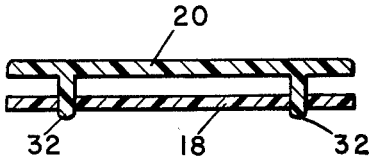
FIG. 3 is a sectional view taken along line 3—3 of FIG. 2.
Figure 2:
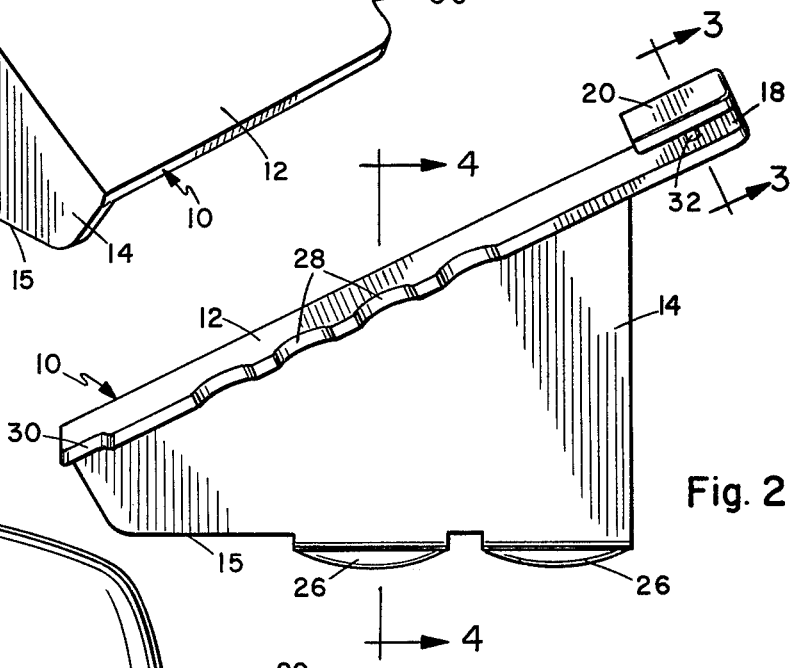
FIG. 2 is a side view of the embodiment illustrated in FIG. 1.

Referring now to FIG. 1, the telephone supported directory information support rack 10 has a first planar member 12 for supporting telephone directory information on its upper flat surface. A second planar member 14 is secured at one of its side edges to the side edge of the first planar member 12 along the line 16. The opposite side edge 15 of the second planar member 14 has a lower surface that generally lies at an acute angle with the edge line 16 of the first and second planar members.

Figure 4:
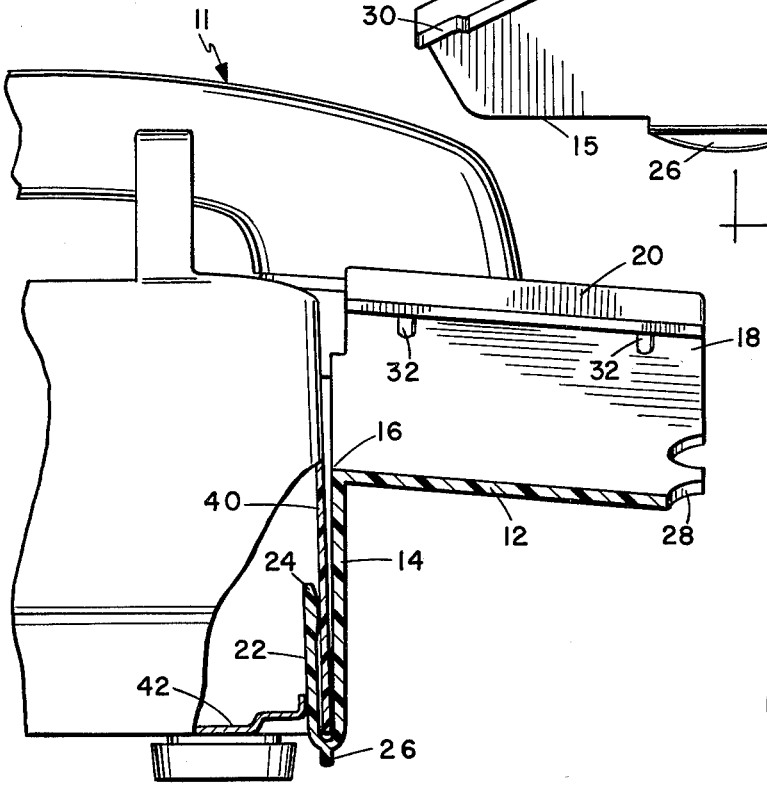
FIG. 4 is a sectional view taken along line 4—4 of FIG. 2, which view also illustrates the mounting of the information support rack onto the side of a normal telephone housing.
Figure 5:
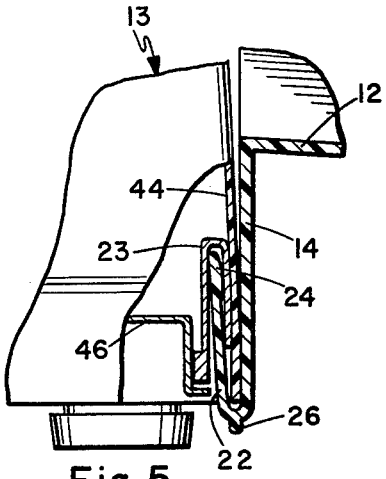
FIG. 5 is a sectional view of the embodiment, illustrating an additional retainer member that is used to secure the information support rack on telephones having a different housing structure.

Retainer means such as the upwardly projecting arms 22 project upwardly and fit between the bottom plate 42 and the side wall 40 of a known telephone housing 11. This supports the first and second planar members with the first planar member being positioned at a slight upward angle corresponding to the lower edge surface 15 of the second planar member. The upper portion of arm 22 has an inwardly projecting portion or enlarged head portion 24 that friction grips the side 40 of the telephone housing 11, as illustrated in FIG. 4, rigidly and solidly holding the rack 10 in position.

A retaining means, plate 20, is secured to the upper end of the first planar member 12 in any suitable manner, such as by pins 32 projecting through openings in the upper end 18 of the planar member 12. Thus leaf or page type directory information is held at its upper edges between end 18 and the member 20, in correct orientation for reading.

Planar member 12 also has notches 28 and 30 to facilitate quick access to layers of telephone directory information that are held by the retainer means 18 and 20.

Installations on telephones, such as telephone 13, that have a different lower structure 46 and spacing between the bottom portion 46 and the side housing 44, is accomplished by a second U-shaped member 23. This U-shaped member 23 has one leg that fits down into the space between arm 22 and second planar member 14 with the other leg of the U-shaped member having an enlarged head portion for fitting into the available space.

While the racks may be made of any suitable material, it is preferably made with an integral construction of suitable plastic or like materials. In a normal installation, the lower edge of support surfaces 26 do not touch the surface on which the telephone is mounted. However, should such surfaces contact the surface on which the telephone is mounted, these surfaces provide the desired bearing and spaced leveling support necessary to maintain the upward angle of the first planar member 12 at the desired orientation.

In operation, the directory information is placed between end 18 and retainer plate 20 and is held in the position to be observed. The rack 10 is then positioned onto the telephone housing by pulling the side portion 40 and 44 outwardly slightly to allow the legs 22 to be moved into the space between the wall portion 40 and the bottom portion 42 or the wall portion 44 and the bottom member 46 to provide a rigid and secure holding of the support rack in the desired and usable position.

Having described my invention, I now claim:

1. A telephone supported directory information support rack comprising:

a first planar member for supporting telephone directory information, a second planar member joined at one of its side edges to one of the side edges of said first planar member, the opposite side edge of said second planar member having an acute angle with the line of intersection of the intersecting side edges of said first and second planar members, said second planar member being at a normal angle with said first planar member, said opposite side edge of said second planar member having securing means for securing said planar members to the side of the telephone with said opposite side edge being substantially horizontal and said first plate member presenting a flat, upwardly inclined surface for presenting directory information to telephone users, retainer means positioned at the upper inclined end portion of said first planar member for retaining telephone directory information in visible position on said first planar member, said securing means comprising at least one upwardly directed leg member that is secured to said opposite side edge, the upper end of said leg member having an enlarged end portion inwardly directed toward said second planar member, a second spaced upwardly directed leg member that is connected to said opposite side edge and which second leg member has an inwardly directed end portion, and a U-shaped clasp member with one side portion being projected between said upwardly directed leg portions and said second planar member and the other side portion having an enlarged edge portion.

2. A telephone supported directory information support comprising, a first rectangular planar member for supporting written information and a triangular shaped second planar member with each member having side edges, said first planar member being connected to said second planar member along their adjacent side edges, said second planar member being at a substantially normal angle with said first planar member, the opposite side edge of said second planar member having an acute angle with the line of intersection of the connected side edges of said first and said second planar members, said opposite side edge of said second planar member having securing means for securing said planar members to the side of a support, said first planar member being inclined upwardly with the upper surface presenting written information to the users thereof and the lower surface of the first planar member being spaced from the opposite side edge of said second planar member by the width of the second planar member providing a free space therebetween, said securing means comprising at least one upwardly directed leg member that is secured to said opposite edge of said second planar member, which leg member is spaced from said second planar member providing a space therebetween for attaching to the side of a support, said securing means including means adjacent the upper edge of said leg member for cooperating with said second member to attach to the support and to position said first planar member in a space projecting position from the surface on which the support is positioned, and the lower edge of said leg member having downwardly projecting edges for providing bearing support for the planar members.

3. A telephone supported directory information support as claimed in claim 2 in which, the upper end of said leg member having an enlarged end portion inwardly directed toward said second planar member.

4. A telephone supported directory information support as claimed in claim 3, including, retainer means positioned at the upper inclined portion of said first planar member for retaining written information in visible position of said first planar member, and said retainer means comprising a plate that is removably secured to said first planar member and having spaced edge portions for coacting with the upper surface of the first planar member to hold the printed information in position on said first planar member.

* * * * *